US008028944B2

(12) United States Patent
Firestone

(10) Patent No.: US 8,028,944 B2
(45) Date of Patent: Oct. 4, 2011

(54) MIXING IMPELLER WITH GRINDING PEGS

(76) Inventor: Daniyel Firestone, Elkins Park, PA (US)

( * ) Notice: Subject to any disclaimer, the term of this patent is extended or adjusted under 35 U.S.C. 154(b) by 480 days.

(21) Appl. No.: 12/102,225

(22) Filed: Apr. 14, 2008

(65) Prior Publication Data

US 2009/0256017 A1 Oct. 15, 2009

(51) Int. Cl.
*B02C 17/00* (2006.01)
*B02C 23/02* (2006.01)

(52) U.S. Cl. ..... 241/172; 366/316; 366/317

(58) Field of Classification Search ..... 241/172; 366/314–317, 325.2, 325.4, 129, 331
See application file for complete search history.

(56) References Cited

U.S. PATENT DOCUMENTS 4,171,166 A * 10/1979 Trowbridge et al. ..... 366/316
5,201,635 A * 4/1993 Steinmetz ..... 416/228
5,888,440 A * 3/1999 Steinmetz ..... 264/255
6,960,014 B2 * 11/2005 Kongstad ..... 366/147
2003/0209618 A1 * 11/2003 Sneeringer et al. ..... 241/172
2005/0011976 A1 * 1/2005 Sneeringer et al. ..... 241/172
2006/0233044 A1 * 10/2006 Freeman ..... 366/316

* cited by examiner

*Primary Examiner* — Bena Miller
(74) *Attorney, Agent, or Firm* — Charles N. Quinn, Esq.; Fox Rothschild LLP

(57) ABSTRACT

The present invention relates to an apparatus and method of manufacturing the apparatus for grinding and evenly disseminating solid materials within a vehicle or carrier. More specifically, the apparatus of the present invention may be comprised of an impeller with a plurality of grinding pegs extending therefrom. The plurality of grinding pegs extend from two faces of the impeller wherein the grinding pegs work in concert with a plurality of grooves on the impeller to finely grind the solid material and improve the turbulent flow within the vehicle. The end result is that the impeller of the present invention improves the efficiency of finely grinding and evenly dispersing the solid particles within the vehicle.

26 Claims, 6 Drawing Sheets

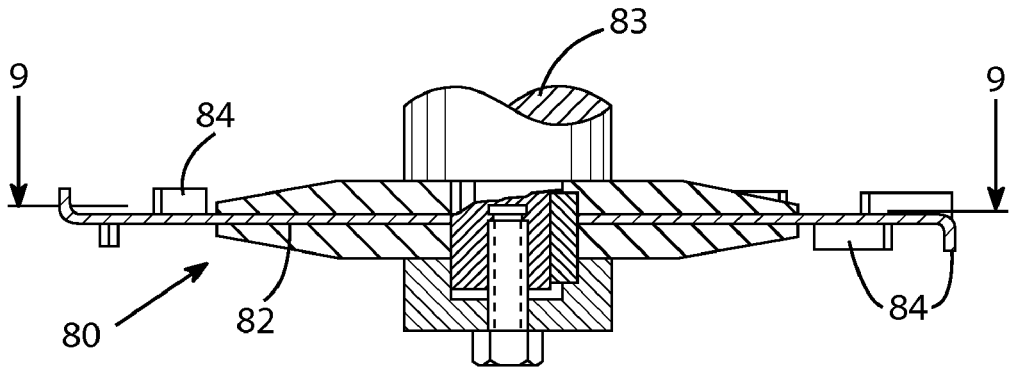
FIG. 1 -- Prior Art
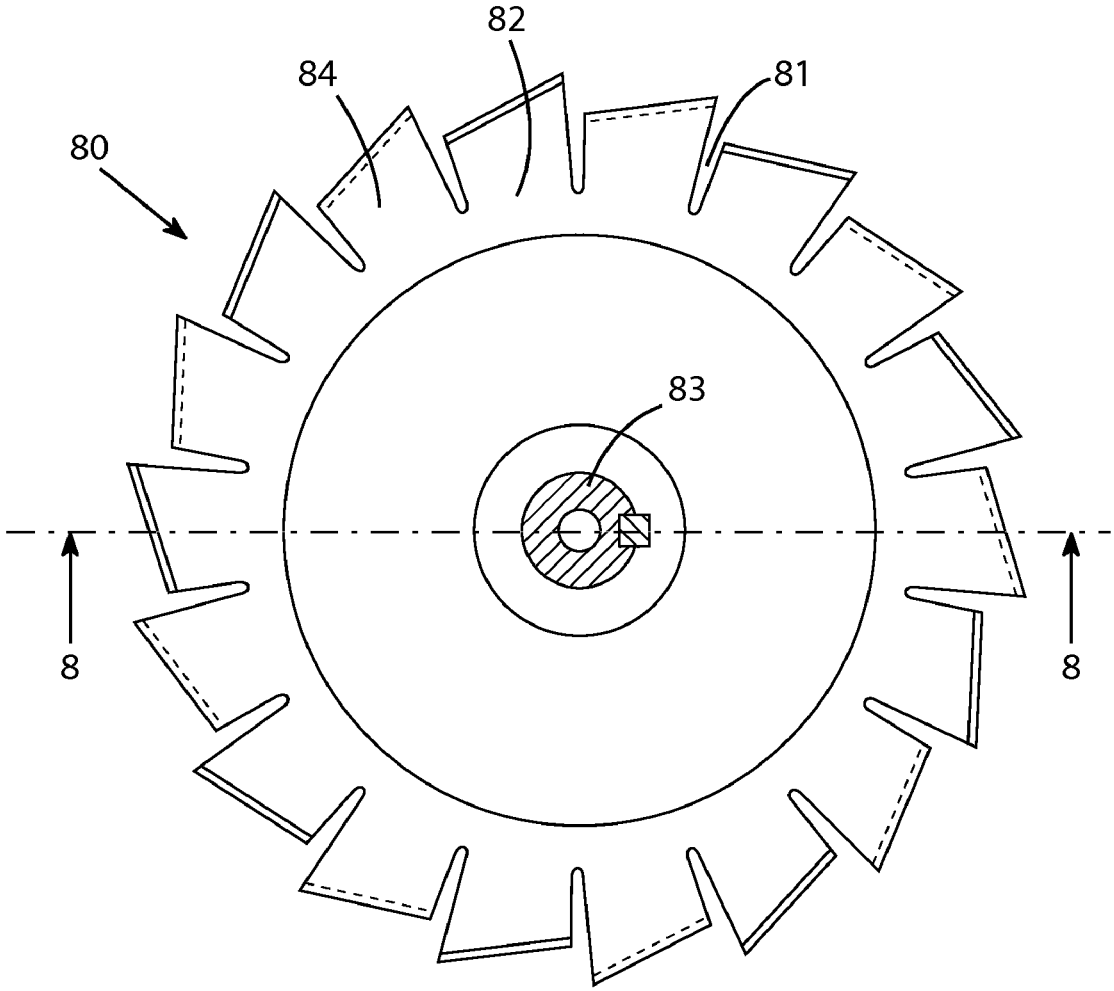
FIG. 2 -- Prior Art

MIXING IMPELLER WITH GRINDING PEGS

FIELD OF THE INVENTION

The present invention relates to an apparatus and method of manufacturing an apparatus for grinding and evenly disseminating solid material within a vehicle or carrier. More specifically, the apparatus of the present invention is comprised of a grooved impeller with a plurality of grinding pegs extending therefrom wherein the grinding pegs improve the efficiency of the impeller in breaking apart the solid matter and evenly dispersing it within the vehicle.

BACKGROUND OF THE INVENTION

The ability of rotary impellers to both finely grind a solid material and evenly disperse it within a vehicle or carrier is important in a wide variety of industrial mixing applications. One example of such a mixing application includes, but is not limited to, mixing solid particles within a liquid slurry, e.g. mixing pigments within paint, sand within paint, sand within water, cement with water, and the like. In alternative examples, the mixing application may include mixing solid particles with a solid particle vehicle, i.e. evenly intermixing two powders. In each of these and other similar examples, the ability to finely grind the solid particles to a desired size and to evenly disperse these particles throughout the vehicle is important toward the effectiveness of the final mixture. Failure to provide a homogeneous final mixture could compromise the integrity of the product and prevent it from functioning properly.

One common operation to mix the solid particles within a vehicle is by an impeller affixed to a rotatable shaft. Referring to FIGS. 1 and 2, a typical impeller 80 generally comprises a flat metal disk 82 having a plurality of vanes or blades 84 extending from its edge and a plurality of grooves 81 between each blade 84. The impeller 80 is adapted to rotate with a rotatable shaft 83 such that the blades 84 and grooves 81 break apart solid particles within a slurry or liquid suspension and/or intermix the solid particles within a vehicle. The action of rotating the blades 84 and grooves 81 also creates a particle flow that disperses the particles relatively evenly throughout the vehicle. Dispersion is further facilitated by a bend slightly upward or downward of each blade 84, relative to the plane of the disk, such that particles flowing along the surface of the disk will be guided below or above the disk. Thus, the bend in the blade causes a vertical particle flow within the vehicle.

A common disadvantage of this type of impeller, however, is severe abrasion. The speed of rotation of the impeller, often rotated at a tangential velocity of 3500-6000 ft/min, increases the friction between the impeller and the slurry. Accordingly, the blades of the impeller quickly erode, especially if used to mix liquids having a high viscosity or abrasive solids suspended therein. Particles of metal may also break away from the impeller and become suspended within the liquid that is being mixed, thereby, contaminating the mixture. Thus, the impeller must be replaced frequently so as to maintain optimal efficiency and not contaminate the slurries. Replacement of each impeller causes a certain amount of down-time for the task at hand and increases the amount of time necessary to completely mix a slurry.

U.S. Pat. No. 4,171,166 ("the '166 patent") and U.S. Pat. No. 5,201,635 ("the '635 patent) set forth a solution to the breakdown of the metallic impeller by providing a polymer-based, disc-like impeller. Specifically, the polymeric impeller contains a plurality of radially extending grooves on each planar face. Upon rotation of the impeller, these grooves create turbulent flow within the liquid vehicle, thereby, dispersing the solid particles throughout the slurry.

The grooves of the '166 and '635 patents, however, are limited in their ability to fully grind the solid material in the slurry. As a result, a greater amount of time is needed for these impellers to grind the solid material and to evenly dispersed it within the liquid vehicle. Greater processing time leads to increased costs associated with preparing the slurry. These increased costs are especially prevalent with viscous slurries and/or hard, dense, solid materials. As such, these impellers are not cheaply applicable for grinding and mixing these types of mixing applications.

Based on the foregoing, there is a need in the art for an apparatus providing an impeller for mixing solids within a vehicle with an improved ability to grind and disperse solid materials therein. As such, there is a need in the art for an impeller that improves the cost and productivity associated with grinding and evenly dispersing solid material within a vehicle, especially with high viscosity slurries and/or vehicle or carriers with hard, dense, solid particles.

The present invention addresses the foregoing needs.

SUMMARY OF THE INVENTION

The present invention relates to an apparatus and method of manufacturing the apparatus for grinding and evenly disseminating solid materials within a vehicle. More specifically, the apparatus of the present invention may be comprised of an impeller with a plurality of grinding pegs extending therefrom. The impeller is, preferably, comprised of bound inner and outer layers and is adapted to be coupled to a rotatable shaft such that the impeller rotates with the shaft. However, as evident below, the impeller is not limited to this particular embodiment and structure. A plurality of grinding pegs extend from the impeller and work in concert with a plurality of grooves on the impeller to finely grind the solid material and improve the turbulent flow within the vehicle, ultimately, improving the efficiency of finely grinding and evenly dispersing the solid particles within the vehicle.

In one embodiment, the impeller may be comprised of bound inner and outer layers of polyurethane resin wherein the hardness and flexibility of the inner and outer layers are unique. To this end, the outer layer may be comprised of a softer more flexible polyurethane than the inner layer. A plurality of grooves may radially extend about the periphery of the outer layer of the impeller such that the grooves are offset on either side of the disk and are adapted to direct fluid flow vertically. As discussed further herein, the present invention is not limited to an inner and outer layer of different polyurethanes and may be comprised of a single layer of polyurethane or a metallic material. Furthermore, the type of material of the impeller may be dictated by the function and the impeller may be comprised of Ultra High Molecular Weight (UHMW) polyethylene, Polytetrafluoroethylene (PTFE), polypropylene, nylon, ceramic and metal.

A plurality of pegs extend from the impeller wherein the pegs increase the efficiency of the impeller to finely grind the solid material within the vehicle and alter the turbulent fluid flow caused by the impeller. The result is that the impeller uniformly grinds the solid particles and increases the efficiency of evenly dispersing the particles within the vehicle. The grinding pegs may be comprised of polyurethane, but are not limited thereto, and are present on either or both faces of the disk, preferably extending from the outer layer of the disk. In a more preferred embodiment, the pegs are evenly spaced about the circumference of the disk such that the pegs extending from one face are circumferentially offset with pegs extending from the opposing face of the disk. The number of pegs may be a function of the properties of the vehicle and the solid particles admixed therein. For example, the number of pegs may be a function of the viscosity or abrasiveness of the vehicle or other the properties associated with the solid particles or vehicle. To this end, more pegs may be used for more viscous or abrasive vehicles and/or particles with properties making them more difficult to grind.

The pegs may be of any shape understood to break apart solid particles within a slurry or other carrier and alter the turbulent flow created by the impeller so as to maximize particle dispersion. Preferably, the pegs are comprised of a three-dimensional polyhedron structure. While the pegs may contain any number of sides, a cubically shaped peg is preferred due to its ability to withstand erosion and wearing, while adequately grinding the solid particle. The pegs, however, are not limited to this configuration and, as discussed further herein, may be comprised of any configuration for facilitating particle dispersion within a vehicle.

The peg containing impeller of the present invention may be mounted to a rotatable shaft by any mechanism known in the art. In one embodiment, the impeller is mounted between two opposing mounting plates all secured to the shaft by a bolt and a plurality of torque transfer pins. The bolt and shaft are adapted to pass through aligned central bores of the mounting plates and the impeller and the torque transfer pins are adapted to pass through aligned openings around the central bore. Finally, in one non-limiting embodiment, a key may be adapted to fit within a notch of the impeller and a corresponding cavity of the shaft wherein the key may be further secured to the impeller and shaft by an additional collar and a screw. The key functions to transfer the rotation of the shaft to the impeller. However, because the rotational forces of the shaft may exert an enormous amount of pressure on the key, the torque transfer pins are adapted to reduce this pressure and prevent the key from breaking. The present invention is not limited to a keyway in accordance with the above. Rather, any similar or other design known in the art to secure the impeller to a shaft may be used in place of the key. To this end, the peg containing impeller of the present invention is not limited to being mounted in accordance with the above and may be mounted to a rotatable shaft by any other means understood in the art to mount an impeller to a rotatable shaft.

The above embodiment of the impeller of the present invention may be manufactured by any means understood in the art. For example, the impeller may be produced within a typically centrifugal casting mold wherein the outer impeller portion is poured into the mold and centrifugally projected outward to fill only outer end of the impeller. While the material is still chemically reactive, another polyurethane material, serving as precursor of the inner impeller portion, is poured into the opening and allowed to flow centrifugally outwardly for tight pressure engagement. To this end, an impeller with different inner and outer polyurethane layers is produced.

Preferably, suitable inserts are provided within the mold so as to shape the desired grooves into the peripheral edge of the impeller. Suitable inserts may also be provided within the mold so as to shape a plurality of holes or recesses for the grinding pegs, where applicable. However, as discussed further herein, this element is not necessarily limiting to the invention, as the grinding pegs may be coupled to the impeller by an adhesive, welding (wherein applicable) and other similar methods known in the art. The present invention is not limited to the above method of producing the present invention and alternative methods of producing an impeller may be utilized, based upon known methods in the art and the composition of the impeller.

The foregoing method of manufacturing the impeller of the present invention is not intended to be limiting. Rather, the impeller of the present invention may be fabricated by any known method in the art. The method of manufacturing the impeller may be dictated by the type of material of the impeller. To this end, known methods of fabricating, molding and/or casting materials comprised of polyurethane, Ultra High Molecular Weight (UHMW) polyethylene, Polytetrafluoroethylene (PTFE), polypropylene, nylon, ceramic and metal are contemplated by the present invention.

Many variations of the present invention may be made without departing from the scope invention. As such, the embodiments herein of the impeller and mounting support are not intended to limit the structure of the present invention. Rather, the impeller of the present invention may be any structure designed to be secured to a rotatable shaft and immersed in a liquid to be mixed, so long as the impeller contains the grinding pegs in accordance with the present invention discussed herein.

DESCRIPTION OF THE DRAWINGS

FIG. 1 is a side view of a metal impeller of the prior art.

FIG. 2 is a top view of a metal impeller of the prior art.

DETAILED DESCRIPTION OF THE INVENTION

The present invention relates to an apparatus and method of manufacturing the apparatus for grinding and evenly disseminating solid materials within a vehicle. More specifically, the apparatus of the present invention may be comprised of an impeller with a plurality of grinding pegs extending therefrom. The impeller is, preferably, comprised of bound inner and outer layers and is adapted to be coupled to a rotatable shaft such that the impeller rotates with the shaft. However, as evident below, the impeller is not limited to this particular embodiment and structure. A plurality of grinding pegs extend from the impeller and work in concert with a plurality of grooves on the impeller to finely grind the solid material and improve the turbulent flow within the vehicle, ultimately, improving the efficiency of finely grinding and evenly dispersing the solid particles within the vehicle.

Figure 3:
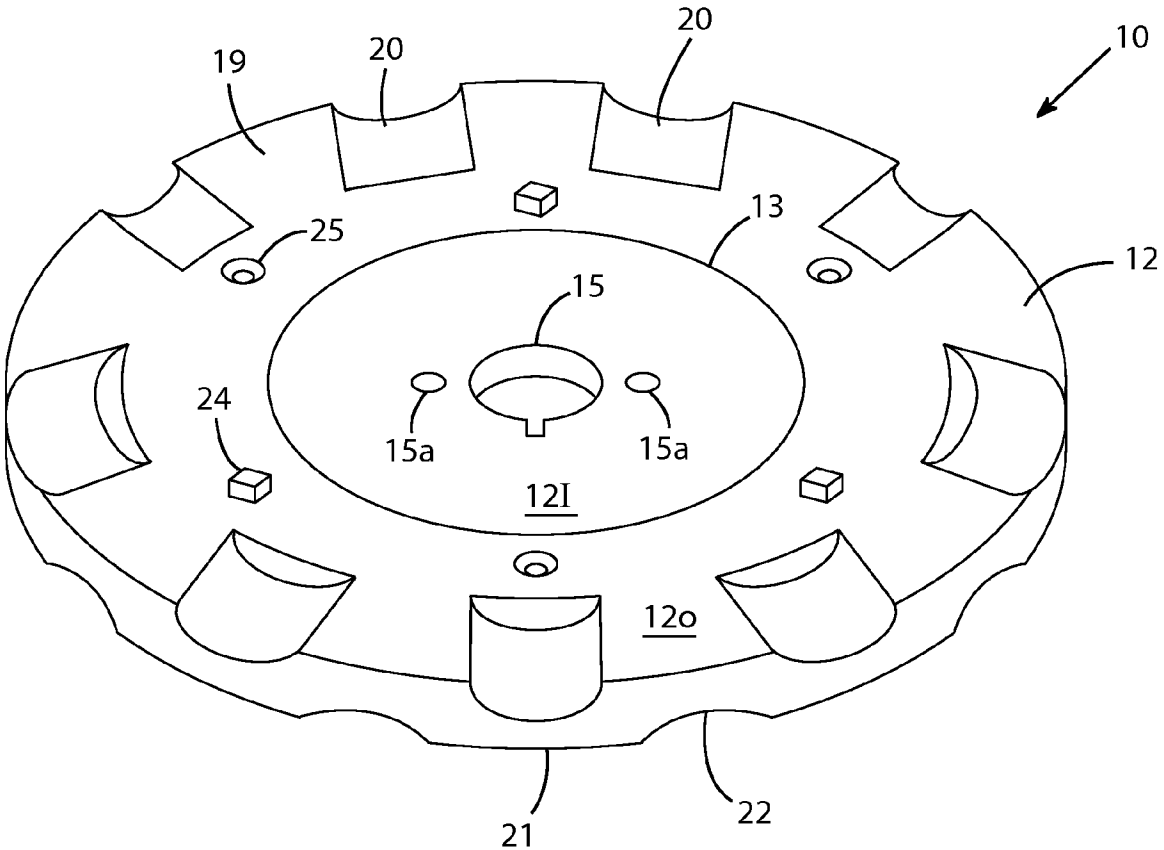
FIG. 3 is a perspective view of one form of the impeller of the present invention.
Figure 4:
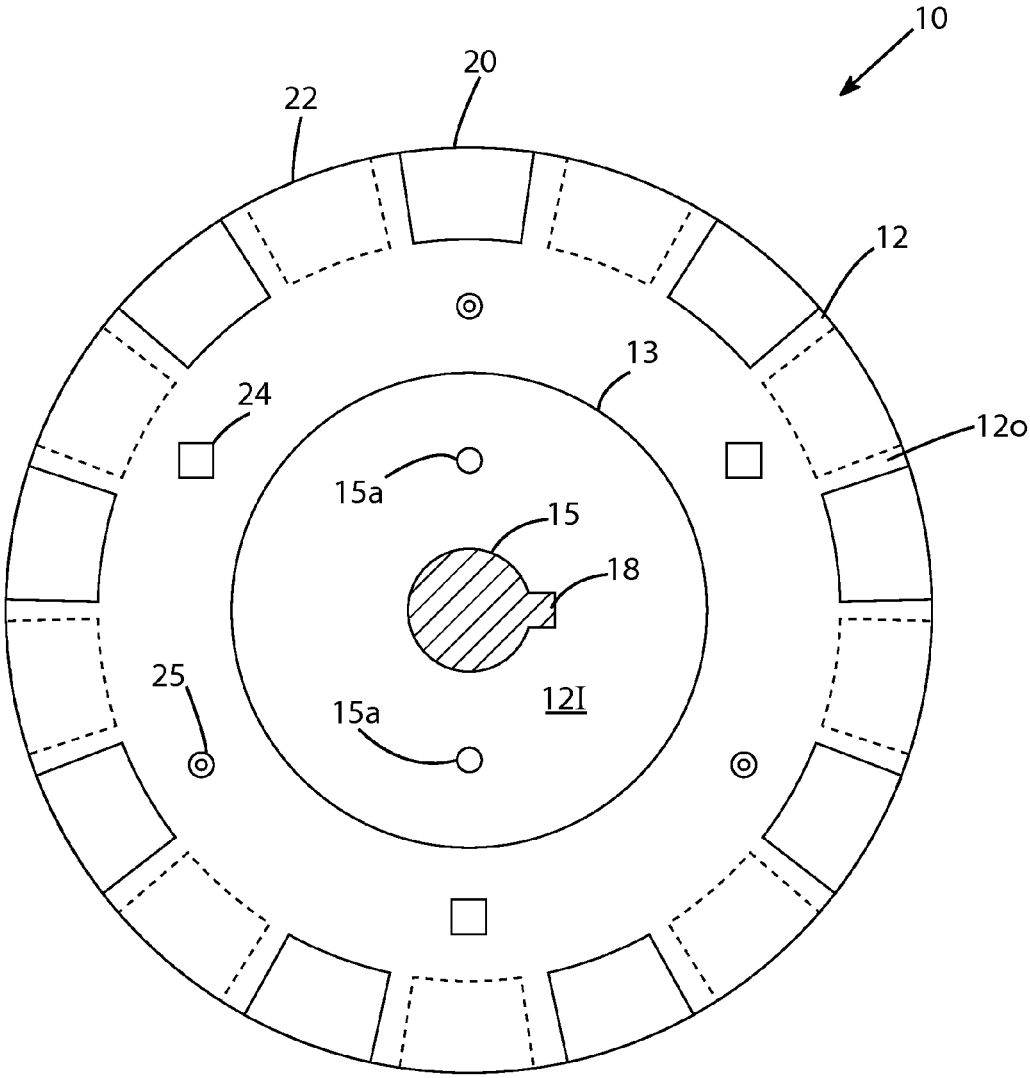
FIG. 4 is a top plan view of a prior art mounting structure for the impeller of the present invention, with an impeller of the present invention shown mounted in place thereon.

Referring to FIG. 3, an impeller 10 of the present invention is illustrated. More specifically, the impeller 10 comprises a disk 12 having a plurality of pegs 24 extending therefrom. In the embodiment illustrated in FIG. 3, the impeller is comprised of a composite structure having at least two different types of polyurethane resins wherein a first, inner, polyurethane resin is represented by 12 I and a second, outer, polyurethane resin is represented by 12 O. The inner and outer polyurethane resins 12 I and 12 O are securely bonded to each other at an interfacial bond 13. Preferably, the inner and outer polyurethane resins 12 I and 12 O are chemically reacted with each other at the interfacial bond 13 so as to form a chemical bond therebetween. As illustrated in FIGS. 3 and 4, the inner disk portion 12 I and the second disk portion 12 O may comprise inner and outer portions of the disk 12 such that the outer disk portion 12 O is concentric with the inner disk portion 12 I.

In one embodiment, the inner polyurethane resin 12 I and the outer polyurethane resin 12 O may be comprised of different physical properties. Specifically, the outer polyurethane resin 12 O may have greater flexibility than the inner polyurethane resin 12 I. The polyurethane resin 12 I may have, for example, a Durometer hardness above about 90 Shore A (more preferably about 75 Shore D) and an elongation at break of about 270%. The more flexible and softer second polyurethane resin 12 O may have a Durometer hardness below about 90 Shore A (more preferably at about 90 Shore A) and a minimum elongation at break of about 400%. However, the second polyurethane resin of the disk is not limited to an elongation break of 400% and may have a minimum elongation break within the range of about 400-800%.

The impeller of the present invention, however, is not limited to a composite structure in accordance with the above. In one embodiment, the impeller may be comprised of a single layer polyurethane. The polyurethane may have a durometer hardness above 90 Shore A that may be at or about 75 Shore D. Alternatively, the polyurethane may have a durometer hardness below 90 Shore A. To this end, the hardness of the polyurethane may be dependant upon the type of material being admixed wherein harder and more abrasive particles require a harder composition, such as those at or around the 75 Shore D scale. Conversely, softer less abrasive materials may require softer materials, such as those at or below 90 Shore A.

The impeller of the present invention is also not limited to a polyurethane composition. Rather, the composition may be a thermoplastic composition selected based upon the operation requirements of the impeller. For example, the impeller may be comprised of an ultra high molecular weight polyethylene, a polytetrafluoroethylene (i.e. Teflon®), polypropylene, nylon, or other similar polymers. In even further embodiments, the impeller may be comprised of other non-polymeric compositions such as ceramic compositions, and metallic compositions. Each of these materials are preferably selected based upon the desired mixing application and the materials used therein.

The impeller of the present invention may also be of any diameter so as to facilitate the admixing of the particles within the vehicle. In one embodiment, the diameter of the impeller may be between 1 inch and 32 inches. In a further embodiment the diameter may be 14 inches, 16 inches, 18 inches, 20 inches, 22 inches, 24 inches, 26 inches, 28 inches, 30 inches, or 32 inches. However, one of ordinary skill in the art will appreciate that the impeller may be of any diameter required for a particular application.

As illustrated in FIGS. 3 and 4, a plurality of first grooves 20 are formed on a first face of the disk 19 of the impeller and a plurality of second grooves 22 are formed on an opposing second face of the disk 21. The first grooves 20 and the second grooves 22 are evenly spaced about the circumference of the edge of the disk 12. More preferably, the grooves 20 on the first face 19 of disk 12 and the grooves 22 on the second face 21 of disk 12 are circumferentially offset. To this end, the grooves on one face are spaced between the grooves on the other face.

As illustrated in FIG. 3, the grooves 20 and 22 are formed in the outer, more flexible, disk portion 12 O with a curved profile. The grooves 20, 22 preferably extend from the edge of disk 12 to approximately one-fourth the distance to the center of the face of disk 12. The center lines of each of the grooves 20 and 22 are radii from the harder, less flexible center of the disk 12, and the sides of each of the grooves 20 and 22 are parallel to the center line. In accordance with the foregoing, the space defined by each groove is preferably a portion of a right cylinder. Although not limited to this configuration, the right cylinder is preferably of a uniform width, length, and depth such that the edges of the grooves do not taper to the center of the disk. There may be between zero to nine such grooves per face, but, preferably, no more than ten grooves on each face 19, 21 of disk 12. The number of grooves 20, 22 may be a function of the viscosity of the intended slurry and/or the properties of the solid particles within the vehicle. To this end, more grooves may be used for more viscous fluids and/or particles with properties making them more difficult to grind. One of ordinary skill in the art will appreciate that the dimensions of each groove is also dependent upon the properties of the solid particles and carrier.

Figure 5:
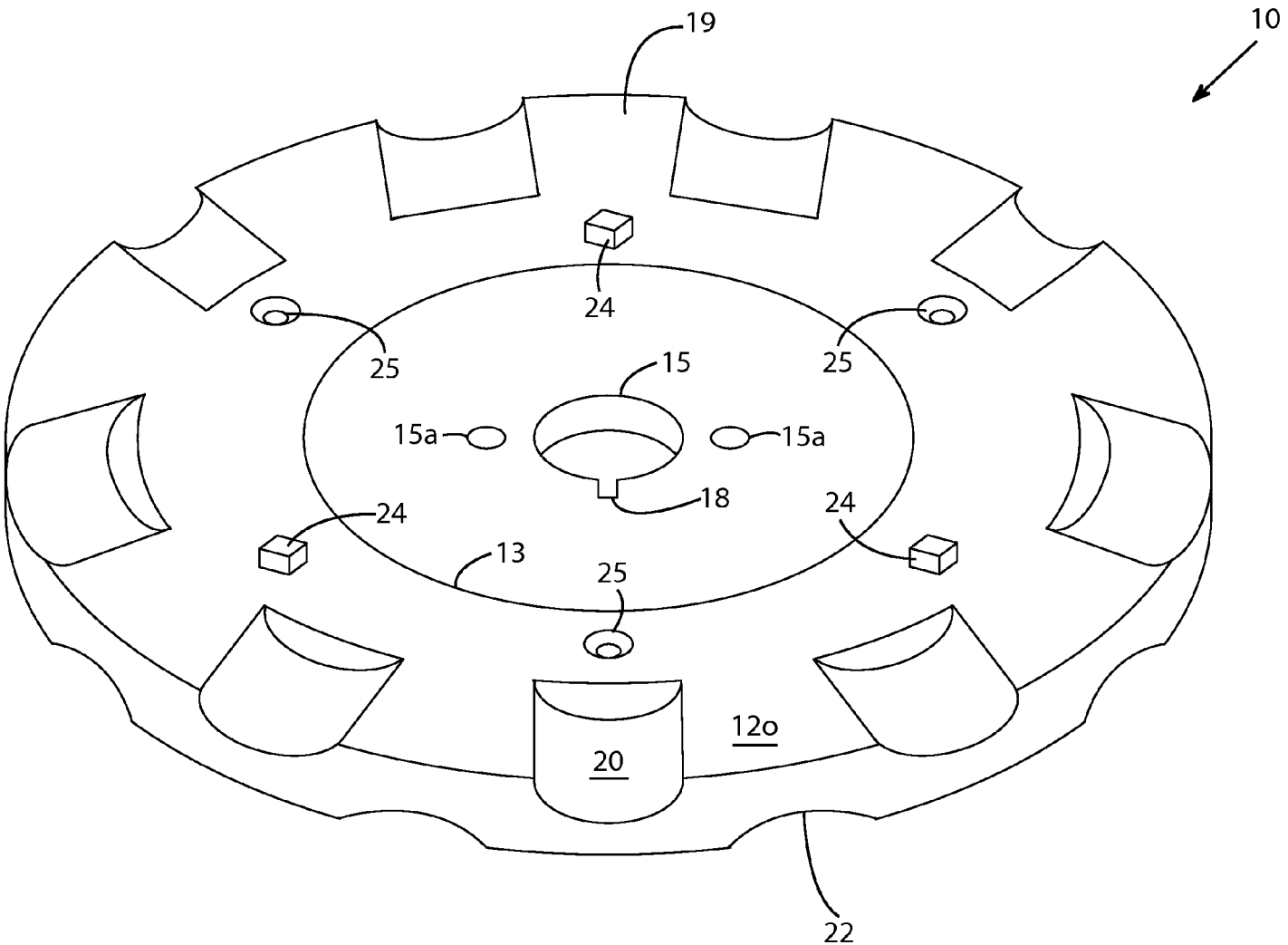
FIG. 5 is a closer view of one form of the impeller of the present invention illustrating the structure of the grinding pegs and their location on the faces of the impeller.

Referring to FIG. 5, a plurality of grinding pegs 24 extend from both the first face of the disk 19 and the second face of the disk 21. The pegs 24 may be evenly spaced about the circumference of the disk 12. More preferably, however, the pegs 24 on the first face 19 of disk 12 and the pegs 24 on the second face 21 of disk 12 are circumferentially offset. To this end, the pegs 24 extending from the first face 19 are spaced between the pegs 24 extending from the second face 21.

As further illustrated in FIG. 5, in one embodiment the impeller 10 of the present invention may be comprised of more than two pegs, preferably three pegs 24, extending from each face 21, 19 of the disk 12. However, the present invention is not limited to this number of pegs 24 per face and may be comprised of any number of two or more pegs. The number of pegs may be a function of the viscosity or abrasiveness of the intended vehicle and/or the property of the solid particles within or admixed with the vehicle. For example, a greater number of pegs may be used for more viscous fluids and/or more abrasive particles with properties making them more difficult to grind.

In one embodiment, the pegs 24 extend from the disk 12 at points radially outboard end of each face of the disk. In one embodiment, the pegs extend from the outer, more flexible, disk portion 12 O of the impeller 10. The pegs 24 may all extend from points of the same radial distance between the inner and outer disk interface 13 and the edge of the disk, or, alternatively, the pegs 24 may be staggered along the periphery of the outer disk portion 12 O. In either case, the pegs 24 preferably extend perpendicularly from the face of the disk at points between two grooves on the same face. For example, the pegs extending from the first face 19 are spaced between the grooves 20. The pegs 24 may also be centered over the longitudinal axis of the grooves 22 on the second face 21 of the disk.

The pegs 24 may be similarly placed on impellers comprised of a single layer composition. For example, in any of the single layer impeller polymeric and non-polymeric compositions discussed herein, the pegs 24 may extend from the disk at a radially outboard end of each face of the disk at positions proximate to the plurality of grooves. The pegs may be equidistant from the center of the disk or staggered along one face of the disk and offset across the two faces of the impeller. Accordingly, the description of the pegs, with respect to the composite impeller structure, is equally applicable any other composition of the impeller, as contemplated herein.

In a further embodiment, the pegs 24 are coupled to and extend through the disk 12 so as not to structurally interfere with the grooves of the impeller. More specifically, one end of each peg 24 extends from one side of the disk and functions to grind and/or disperse solid particles within a vehicle. The opposing end 25 of each peg, however, may extend through the disk 12 to the opposing face. Because it is preferable that the opposing end 25 of the peg 24 not interfere with the surface of the grooves, the opposing end 25 of the pegs 24 is desirably flush with the opposing face of the disk 12. By way of illustration, FIG. 5 shows that that the opposing ends 25 are flush with the surface of the first face 19 and correspond with pegs 24 extending from the second face 21. Similarly, the pegs 24 illustrated on the first face 19 correspond with an opposing end 25 that is flush with the second face 21.

The foregoing embodiment of the pegs, relative to the disk, is not intended to be structurally limiting to the present invention. Rather the pegs may be molded with the impeller such that the peg is completely integral with the impeller disk. Alternatively, the peg may extend only partially through a first face of the disk and is receivable by a mechanical locking device or plug that mates with the peg from an opposing face of the disk. For the foregoing reasons, it is preferable that the plug is flush with the opposing face of the disk so as not to interfere with the action of the impeller. In an even further embodiment, the peg may be welded to the face of the disk (this embodiment is most applicable when the impeller is metallic). To this end, the pegs may be coupled to the impeller using any method understood in the art to couple a peg of the composition disclosed herein to a polymeric or non-polymeric impeller in accordance with the foregoing.

The pegs 24 may be of any shape understood to break apart or disperse solid particles within a vehicle and alter the turbulent flow so as to maximize particle dispersion. It is desirable that the pegs 24 be comprised of at least two sides angled relative to each other so as to create at least two edges. While the pegs may contain any number of sides, a cubically shaped peg is preferred due to its ability to withstand erosion and wearing, while adequately grinding the solid particle. The present invention is not limited to a cubical shape, however, and may be comprised of a tetrahedron, pentahedron, hexahedron, heptahedron, or any other similar polyhedron structure known in the art. Moreover, the present invention may be cylindrical with a rounded end (i.e. bullet shaped), cylindrical with a flat end, conically shaped or in any other similar rounded shaped so as to effectively alter the turbulent flow during the mixing process.

The size of the pegs 24 may be dependent upon the size of the impeller. In one embodiment, the pegs may have a width or diameter between 0.25 inches and 1.00 inch and a height between 0.25 inches and 1.00 inches. For example, in embodiments wherein the impeller disk is between 14 inches and 16 inches the pegs, when a cubical shape, are 0.50 inches squared with a 0.50 inch height and are preferably oriented in a diamond pattern from the center of the disk. In embodiments wherein the impeller disk is between 18 inches and 20 inches the pegs, when a cubical shape, are 0.63 inches squared with a 0.63 inch height and are preferably oriented in a diamond pattern from the center of the disk. In embodiments wherein the impeller disk is between 22 inches and 24 inches the pegs, when a cubical shape, are 0.75 inches squared with a 0.75 inch height and are preferably oriented in a diamond pattern from the center of the disk. In embodiments wherein the impeller disk is between 26 inches and 28 inches the pegs, when a cubical shape, are 0.88 inches squared with a 0.88 inch height and are preferably oriented in a diamond pattern from the center of the disk. In embodiments wherein the impeller disk is between 30 inches and 32 inches the pegs, when a cubical shape, are 1.00 inches squared with a 1.00 inch height and are preferably oriented in a diamond pattern from the center of the disk. The present invention, however, is not limited to these measurements and the size and shape of the peg may be altered based upon the application and desired effect of the impeller disk.

In a further embodiment, the pegs may be comprised of a polyurethane resin. Specifically, the pegs may be comprised of a polyurethane consistent with the specifications of the flexible, softer outer polyurethane resin 12 O. To this end, the pegs 24 have a Durometer hardness below about 90 Shore A (more preferably at about 90 Shore A). In an alternative embodiment, the pegs may be comprised of a similar hardness as the inner polyurethane resin 12 I, i.e. above 90 Shore A and preferably at or about 75 Shore D. In a further embodiment, the pegs may be comprised of any alternative material contemplated for the impeller. For example, the pegs may be comprised of a thermoplastic composition selected based upon the operation requirements of the impeller. The impeller may also be comprised of an ultra high molecular weight polyethylene, a polytetrafluoroethylene (i.e. Teflon®), polypropylene, nylon, or other similar polymers. In even further embodiments, the peg may be comprised of other non-polymeric compositions such as ceramic compositions, and metallic compositions. The type of material selected may be based upon the desired mixing application, the materials used therein, and the desired characteristic of the composition of the peg.

Figure 6:
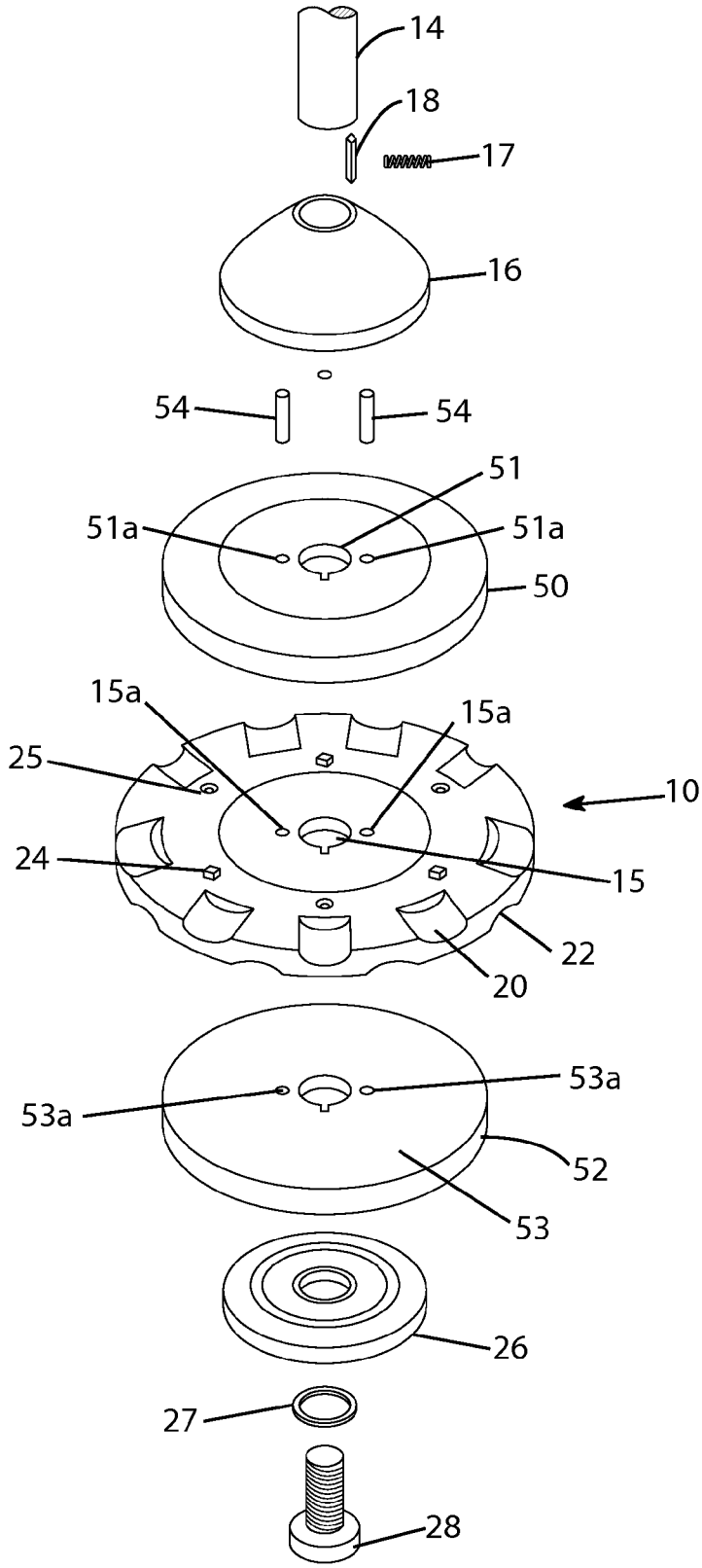
FIG. 6 is an exploded view showing another prior art mounting structure for the novel impeller of the present invention, with an impeller of the present invention depicted in position for mounting using such prior art mounting structures.

Referring to FIG. 6, one type of mounting means is illustrated for attaching impeller 10 of the present invention to a rotatable shaft 14. Specifically, the impeller 10 is adapted to be coupled to the shaft 14 by way of a central bore 15. In addition to central bore 15, the impeller 10 of this embodiment further includes a plurality of openings 15*a* arranged around the central bore 15. These plurality of openings are adapted to engaged an upper and lower mounting plate 50 and 52, respectively, providing additional support to the impeller 10.

The upper mounting plate 50 has a central bore 51 with surrounding small bores 51*a*, which align with the central bore 15 and surrounding bores 15*a*, respectively, of the disk 12. Similarly, lower mounting plate 52 includes central bore 53 with surrounding bores 53*a*, which also align with openings 15 and 15*a* of the disk 12. The central bores 51, 15 and 53 are sized to accept a central bolt 28 therethrough wherein the central bolt threadingly engages shaft 14. In a preferred embodiment, the bolt 28 extends through a lock washer 27, a retaining washer 26, the plates 50 and 52, the disk 12 and threads into the lower end of the shaft 14 to couple the impeller and mounting plates to the shaft.

In the above configuration, once assembled to the shaft, the inner polyurethane portion of the disk 12 I is obscured from view and isolated by the upper mounting plate 50 and the lower mounting plate 52. The outer polyurethane portion of the disk 12 O extends beyond the periphery of the upper and lower mounting plates 50, 52 such that the pegs 24 and grooves 20, 22 are able to contact the vehicle when exposed thereto. When the impeller is comprised of any alternative composition, the radially inboard portions of the disk are relatively obscured from view and isolated by the upper mounting plate 50 and the lower mounting plate 52. The radial outboard portions of the disk extend beyond the periphery of the mounting plates such that the pegs and grooves are exposed. To the end, the impeller may be secured to the plates in any similar configuration so long as the plates do not occlude or interfere with the action of the pegs.

In an alternative embodiment, the upper and lower mounting plates 50, 52 may be replaced by a single mounting plate. More specifically, the single mounting plate may be premolded to receive the impeller disk or may be embedded into the center of the disk. To this end, the present invention includes any similar adaptations known in the art for securing an impeller to a shaft.

Figure 7:
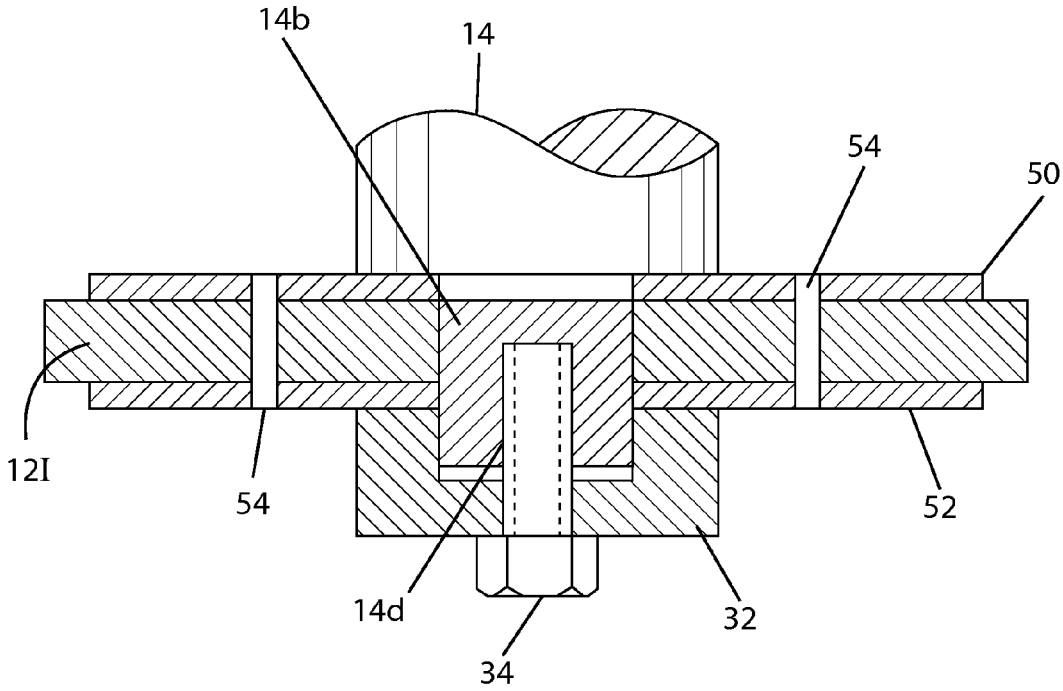
FIG. 7 is a sectional view through the center of an alternative mounting structure for the impeller of the present invention.

FIGS. 4 and 7 illustrate another embodiment of a mounting structure of the present invention, in which the rotatable shaft 14 terminates in a substantially cylindrical, reduced-diameter portion 14*b*. (FIG. 7) The reduced diameter portion 14*b* fits into the central bores 15, 51, and 53, and is of sufficient length so as to fit through the opposite side of the bore 15, 51, and 53. A cap 32 may fit over the protruding region of reduced diameter portion 14*b*. The cap 32 defines an opening to accept bolt 34. Bolt 34 is anchored within a threaded cavity 14*d* within reduced diameter portion 14*b*. To this end, the bolt 34 threadingly secures cap 32 against impeller 10 and, thereby, secures impeller 10 to the shaft 14.

In either of the two embodiments, as illustrated in FIG. 4, adjoining the shaft 14 where it passes through opening 15 of impeller 10 is a key 18. The key is preferably, but not limited to, a square shape and fits into a corresponding cavity in central openings 15, 51, and 53. The key is secured to the impeller and against the shaft by a collar 16 wherein a set screw 17 is adapted to threadingly engage the collar 16 and urges the key 18 against the side of shaft 14 and into the cavity of the central bore openings 15, 51, and 53. The shaft 14 may be also be provided with a shallow cavity in its side to accept the key 18 and further stabilize it within the impeller.

In either of the above configurations, the key 18 aids in transferring rotary motion from the shaft 14 to the impeller 10. However, rotational speeds and/or high density of the liquid being mixed may result in extremely high stresses being placed on key 18. Accordingly, the mounting plates 50, 52 are additionally coupled to the impeller by a plurality of torque transfer pins 54 are disposed through the aligned surrounding openings 51*a*, 15*a*, and 53*a* so as to provide added support for the torque of the impeller 10. The torque transfer pins are preferably in the form of roll pins or solid pins so as to engage openings in mounting plates 50 and 52, as shown, thus securing the mounting plates to the impeller 10.

It is preferable that the torque transfer pins 54 are disposed at a distance from the center of the impeller greater than the diameter of shaft 14, such that the ends of the torque transfer pins 54 do not interfere with the secure contact between the surface of the mounting plates 50 and 52 and the shaft. Spacing the torque transfer pins 54 a sufficient distance from the center of the impeller 10 also has the advantage of allowing either face of the impeller 10 to face upward relative to the shaft 14, as further explained below. Finally, while two openings 15*a* and 15*b* and pins 54 are illustrated in FIGS. 6 and 7, the present invention is not limited to this configuration and may include any number of pins and openings so as to secured the impeller 10 to the shaft and mounting plates. The number of pins and openings also may be a function of the viscosity of the intended vehicle and/or the property of the solid particles within the vehicle. To this end, more pins and openings may be used for more viscous fluids and/or particles with properties making them more difficult to grind.

The present invention is not limited to the above mounting structures and may be varied or adapted in accordance with alternative mounting structures known in the art. In one embodiment, the mounting structure may be comprised solely of torque pins and without the key 18. In further examples, the key 18 may be replaced with a similar torque transferring mechanism known in the art for securing the impeller to a shaft. For example the mounting structure may accommodate "Hockmeyer" machinery having shafts which require attachments to a metal bushing disposed around the central bore opening. Alternatively, the mounting structure may include a "Taper-Lock" type of bushing, in which a bushing at the center of the impeller forms a tapered surface and the side edges of the shaft are urged against the inner surface of the bushing by means of screws disposed parallel to the central opening. To this end, the mounting structure may also include any further structure known in the art for mounting a mixing impeller to a rotatable shaft Based on the foregoing, the structure of the impeller of the present invention may be derived from a typical centrifugal casting mold. More specifically, according to one form of the method, a limited quantity of a polyurethane batch serving as a precursor for the outer impeller portion 12 O is poured into an opening of the mold and is centrifugally projected radially outwardly to fill only the space 12 O located outwardly of the interface 13. While this material is still soft and pliable enough to be chemically reactive another batch, a polyurethane material serving as precursor of the inner impeller portion 12 I is poured into the opening and allowed to flow centrifugally outwardly for tight pressure engagement at interface 13 with the outer polyurethane 12 O. Under temperature conditions suitable for reaction, the two different polyurethane materials are centrifugally bonded to each other chemically, physically or both in a manner to produce an impeller of the present invention.

Suitable inserts may be provided to shape the desired grooves into the peripheral edge of the impeller. Moreover, suitable inserts may be provided to shape a plurality of holes for the grinding pegs 25.

In accordance with the various alternative embodiments, however, the present invention is not limited to cast molding in accordance with the above. Rather, similar technique known in the art for molding, casting or fabricating an impeller of any of the compositions discussed above are contemplated herein. To this end, similar means for providing the shape of the desired grooves and holes for the pegs, where applicable, are contemplated by the present invention.

In each of the foregoing embodiments, the impeller 10 is preferably designed so that it may be turned over relative to the end of shaft 14, allowing either face 21, 19 of disk 12 to face upward. Turning the impeller 10 over has the effect of abrading opposite edges of the vanes. This feature is useful in that the side of the groove against which vehicle is flowing when the impeller is rotating may tend to wear down faster than the opposite edge on the same groove. By turning the disk over the user can expose the lesser-worn edges of each of the grooves to the direct shearing of the vehicle, thus extending the life of the impeller.

When the impeller is immersed into a vehicle and rotated, the motion of the impeller sets up a vibration around the periphery of the disk 12. The alternating configurations of the grooves 20 and 22 on the first and second faces 21, 19 of the disks 10 induce an up and down motion of the vehicle around the periphery of the impeller, thereby, establishing a vortex. The action of the grinding pegs 24 provide an additional element that breaks finely grinds the solid particles within the slurry and alters the turbulent flow from the grooves. In fact, it has surprisingly been discovered that the grinding pegs according to this invention dramatically improved the ability of an impeller to grind solid particles within a wide range of vehicles. This is, most notably, due to the ability of the pegs to cause a split in the vortex established by the grooves. This split creates faster velocities and more particle to particle collisions so as to improve the shear and impact rates of the particles. The impeller of the present invention is, accordingly, advantageous because the pegs provide an improved ability to grind and disperse solid particles within a wider variety of applications. This results in a reduction of processing time require to mixed the vehicle and a more efficient use of the impeller.

It will be appreciated that many variations may be made without departing from the invention. As such, the above embodiments of the impeller and mounting support are not intended to limit the structure of the present invention. Rather, the impeller of the present invention may be any structure designed to be secured to a rotatable shaft and immersed in a vehicle to be mixed, so long as the impeller containing the grinding pegs is in accordance with the above. While the impeller may be of any of the foregoing structures, it is preferred that the impeller be comprised of the polyurethane composite above because it has been found that the composite polyurethane impeller has a life drastically longer than metal impellers or even polymeric impellers of the prior art. To this end, and in accordance with the above, the groove design may be the same as or different than a prior art disk made of a single type of polyurethane resin.

In other embodiments, for example, more than two different polyurethanes may be used to form a multiple layer impeller. The juncture of the outer end of interface 13 may be closer to or farther removed from the disk center. Various mechanical connections may be used to connect the impeller to the rotating shaft, and the number, spacing, shape and configuration of the grooves may be widely varied. Indeed, while the grooves are preferably formed only in the outer layer 12 O, they may be present in both layers if desired.

I claim:

1. An impeller for evenly dispersingly mixing solid particles within a liquid vehicle, comprising;

an imperforate circular polymer disk, having a circular inner portion and an annular outer portion that are of differing flexibility, including oppositely directed circular faces, the disk being mountable on a rotatable shaft, each oppositely directed face having a plurality of radially extending grooves therein, each groove being formed about a centerline that is a radius of the disk, edges of each groove being parallel with the disk centerline, the surface of each groove between the groove edges being the shape of the curved portion of a right cylinder, each groove communicating with the circular periphery of the disk and having length in the radial direction no greater than one-quarter the diameter of the disk, grooves on one face of the disk being circumferentially offset with respct to grooves on the other face so that a groove on one face is circumferentially spaced between the two adjacent grooves on the remaining face; and a plurality of cubically configured pegs extending perpendicularly outwardly, parallel with the axis of rotation of the shaft, from each oppositely directed circular face of the disk, the pegs being positioned on a circle that if drawn would be radially inboard of the grooves but outboard of juncture of the circular and annular portions of the disk, each peg being angularly equidistant from and located at a position that would be between adjacent grooves if the grooves extended radially inwardly to the circle, pegs on a respective face of the disk being angularly offset from pegs on the remaining face, the pegs being in a diamond-like orientation relative to a radius of the circle such that a radius, if drawn, would pass through the two vertices defining juncture of two different lateral surfaces of the cubically configured peg.

2. The impeller of claim 1 wherein at least two pegs extend from each oppositely directed faces.

3. The impeller of claim 1 wherein the pegs are coupled to the disk such that each peg passes from one face of the disk substantially through the disk and is flush with the opposite face of the disk.

4. The impeller of claim 1 wherein the pegs are molded within the disk.

5. The impeller of claim 1 wherein the plurality of pegs are polyurethane.

6. The impeller of claim 5 wherein the polyurethane has a Durometer hardness at or below about 90 Shore A.

7. The impeller of claim 5 wherein the polyurethane has a Durometer hardness at or above about 90 Shore A.

8. The impeller of claim 5 wherein the polyurethane has a Durometer hardness at or about 75 Shore D.

9. The impeller of claim 1 wherein the pegs are a material selected from the group consisting of ultra high molecular weight polyethylene, a polytetrafluoroethylene, polypropylene, and nylon.

10. The impeller of claim 1 wherein the pegs are a thermoplastic material.

11. The impeller of claim 1 wherein the a first polyurethane resin forms the circular portion of the disk and a second polyurethane resin forms the annular portion of the disk.

12. The impeller of claim 11 wherein the first polyurethane resin has a hardness at or below 90 Shore A.

13. The impeller of claim 11 wherein the second polyurethane resin has a harness at or above 90 Shore A.

14. The impeller of claim 13 wherein the second polyurethane resin has a harness about 75 Shore D.

15. The impeller of claim 11 wherein the polyurethane resins are bound together by an interfacial chemical bond.

16. The impeller of claim 1 wherein the disk is comprises polyurethane.

17. The impeller of claim 16 wherein the polyurethane has a Durometer hardness at or below about 90 Shore A.

18. The impeller of claim 16 wherein the polyurethane has a Durometer hardness at or above 90 Shore A.

19. The impeller of claim 16 wherein the polyurethane has a Durometer hardness at about 75 Shore D.

20. The impeller of claim 1 wherein the disk comprises a material selected from the group consisting of ultra high molecular weight polyethylene, a polytetrafluoroethylene, polypropylene, and nylon.

21. The impeller of claim 1 wherein the disk comprises a thermoplastic material.

22. The impeller of claim 1 wherein the pegs extend perpendicularly from the disk surface a distance that is one-thirtieth the diameter of the disk.

23. The impeller of claim 1 wherein the ratio of peg height to disk height is 1:30.

24. An impeller for evenly mixing solid particles within a liquid vehicle, comprising:

an imperforate circular polymer disk including oppositely directed circular faces, the disk being mountable on a rotatable shaft, each oppositely directed face having a plurality of radially extending grooves therein, each groove being formed about a centerline that is a radius of the disk, edges of each groove being parallel with the disk centerline, the surface of each groove between the groove edges being the shape of the curved portion of a right cylinder, each groove communicating with the circular periphery of the disk and having length in the radial direction no greater than one-quarter the diameter of the disk, grooves on one face of the disk being circumferentially offset with respect to grooves on the other face so hat a groove on one face is circumferentially space between the two adjacent grooves on the remaining face; and a plurality of polyhedron-shaped pegs extending perpendicularly outwardly, parallel with the axis of rotation of the shaft, from each oppositely directed circular face of the disk, the pegs being positioned on a circle that if drawn would be radially inboard of the grooves, each peg being angularly equidistant from and located at a position that would be between adjacent grooves if the grooves extended radially inwardly to the circle, pegs on a respective face of the disk being equilaterally spaced from one another and angularly offset from pegs on the remaining face, the pegs being in a diamond-like orientation relative to a radius of the circle such that a radius, if drawn, would pass through the two vertices defining juncture of two different lateral surfaces of the polyhedron-shaped peg.

25. The impeller of claim 24 wherein the pegs extend perpendicularly from the disk surface a distance that is one-thirtieth the diameter of the disk.

26. The impeller of claim 24 wherein the ratio of peg height to disk height is 1:30.

* * * * *